US005953914A

United States Patent [19]

Frangipane

[11] Patent Number: 5,953,914

[45] Date of Patent: Sep. 21, 1999

[54] STEAM POWERED HEAD DEVICE FOR PRODUCING A HIGH RPM ENGINE

[76] Inventor: Richard Frangipane, 3446 53rd St. North, St. Petersburg, Fla. 33710

[21] Appl. No.: 08/888,960

[22] Filed: Jul. 7, 1997

[51] Int. Cl.[6] ..... F16D 31/02

[52] U.S. Cl. ..... 60/370; 91/180; 91/480

[58] Field of Search ..... 91/180, 480; 123/190.6; 60/370, 407

[56] References Cited

U.S. PATENT DOCUMENTS 749,958 1/1904 Crompton ..... 91/180

1,841,344 1/1932 Baer ..... 123/190.6

*Primary Examiner*—Noah P. Kamen

*Attorney, Agent, or Firm*—Joseph C. Mason, Jr.; Dennis G. LaPointe

[57] ABSTRACT

A productive, efficient and environmentally friendly Steam Powered Head Device for integral use with an engine which operates at high RPM. The inventive device includes a head block with integral cylindrical rotating valve through a longitudinal cylindrical aperture in the head block. A high temperature seal bearing is circumferentially pressed fit around the cylindrical rotating valve at each end of the aperture within said head block. The head block and cylindrical rotating valve include intake steam ports and larger exhaust steam ports to allow rapid discharge of steam which are aligned and sequentially arranged through the axis of the cam shaft according to the degrees recommended by the manufacturer of the high RPM engine to which the inventive device is adapted. One intake steam port and one exhaust steam port is typically aligned to each cylinder chamber of the high RPM engine to which the inventive device is adapted. The cylindrical rotating valve includes an extended portion outside the head block with an integral keyway to secure a sprocket or pulley to maintain a 2 to 1 ratio with the high RPM engine crankshaft thereby providing high RPM in the engine. Additional sprocket or pulleys may be secured to the extended portion of said cylindrical rotating valve to drive other engine components such as an air conditioning compressor or an alternator. The head block and cylindrical rotating valve are typically made from non-corrosive material such as stainless steel, brass or aluminum. In addition to replacing gasoline or diesel as a means to power an engine, a Steam Powered Head Device for High RPM Engines eliminates the need to lubricate an engine with oil. A liquid propane gas-fired boiler system can be used to generate the steam.

11 Claims, 3 Drawing Sheets

STEAM POWERED HEAD DEVICE FOR PRODUCING A HIGH RPM ENGINE

BACKGROUND OF THE INVENTION

1. Field of the Invention

The present invention relates to a steam powered head device for integral use with an engine which operates at high RPM.

2. Description of the Prior Art

The use of steam powered generation systems is known in the prior art. Known prior steam powered generation systems include U.S. Pat. No. 4,120,160; U.S. Pat. No. 3,990,238; U.S. Pat. No. 3,759,141; U.S. Pat. No. 84; U.S. Pat. No. 512,993; U.S. Pat. No. 556,965; U.S. Pat. No. 93,276; U.S. Pat. No. 105,581; and U.S. Pat. No. 4,259,841.

While a number of these known prior art devices involve steam powered generation systems, such prior art functions to generate power for turbines, pressurizers, and various other purposes. Such prior art does not contemplate or suggest prior art devices for use with High RPM engines which typically use fuel combustion to generate power. Therefore a device which is simple, easy to fabricate for a manufacturer and is pollution-free would be desirable to power multiple cylinder automobiles and truck engines and two and four cycle engines used in a multitude of applications.

While the prior art devices fulfill their respective, particular objectives and requirements, the aforementioned prior patents do not disclose a steam powered head device used integrally with a high RPM engine as an alternative power source means for engines which typically would have utilized fuel combustion to generate power, as described above.

The inventive device provided herein includes a head assembly comprising a head block, a cylindrical rotating valve within said head block, the cylindrical rotating valve being supported at each end of the head block with pressed high temperature seal bearings. Said cylindrical rotating valve extends outside the head block on one end. A keyway is longitudinally provided at such extended end for securing one or more sprocket or pulleys. The head block and cylindrical rotating valve are provided with intake and exhaust steam ports aligned perpendicular to the longitudinal axis of the cam shaft. The exhaust steam ports are sized larger than the inlet steam ports to allow rapid exhaust of steam cylinder chambers in the engine block to which the steam powered head device is adapted.

One intake steam port and one exhaust steam port through the head block are aligned to adapt to each cylinder chamber of the engine block to which the steam powered head device is adapted. The intake steam ports in the cam shaft are aligned radially and sequentially according to the degrees recommended by the manufacturer of the engine block to which the steam powered head device is adapted. Each exhaust steam port in the cylindrical rotating valve is aligned 90 degrees relative to its respective intake steam port in the cam shaft.

A sprocket gear is typically attached to the cylindrical rotating valve end extending outside the head block, said sprocket gear providing preferred means to drive a crankshaft in the engine to which the steam powered head device is adapted. The sprocket is sized to maintain a 2 to 1 ratio with the engine crankshaft thereby providing high RPM in the engine. An additional sprocket may be typically attached to the cylindrical rotating valve end outside the head block, means to drive other components such as an air conditioning compressor or an alternator. A dented pulley may be substituted for a sprocket.

Steam is supplied to the steam powered head device by means of tubes or pipes connected to the top intake steam ports of the head block. Exhausted steam is routed back for recycling through the steam supply system by means of tubes or pipes connected to the top exhaust steam ports in the head block.

The steam powered head device, is constructed with non-corrosive material, for example, stainless steel, copper, brass, or aluminum. The rotational direction of the cylindrical rotating valve within the steam powered head device is predetermined by a starter motor.

In these respects, the steam powered head device according to the present invention substantially departs from the conventional concepts and designs of prior art, and in so doing, provides an apparatus primarily developed for the purpose of providing productive, efficient, and pollution-free generation of power utilizing steam in an engine. Because steam is a lubricant, there is no need for an engine block to use oil to lubricate the pistons. The crankshaft of an engine can be lubricated with grease by means of grease fittings. Further, where a steam powered generation system is more efficient if heat can be conserved, an engine need not be equipped with a water cooling system. Heat may be conserved by insulating the steam powered head device and associated engine block. Steam may be generated by means of a liquid propane gas fired boiler system.

SUMMARY OF THE INVENTION

The general purpose of the present invention, which will be described subsequently in greater detail, is to provide a steam powered head device for high RPM engines which has many of the advantages of the prior art devices mentioned heretofore and many novel features that result in productive, efficient, and pollution-free means to power a high RPM engine, which is not anticipated, rendered obvious, suggested, or even implied by any of the prior art steam generation systems, either alone or in combination thereof.

To attain this, the present invention generally comprises a head block with an integral cylindrical rotating valve, having multiple steam ports along said the cylindrical rotating valve's longitudinal dimension. The steam ports are perpendicular to the cylindrical rotating valve to allow sequential steam flow therethrough. The cylindrical rotating valve is integral to and movably located in said head block such that the cylindrical rotating valve can rotate within said head block.

The cylindrical rotating valve extends outside the head block on one end of said head block, the cylindrical rotating valve having a keyway on the outside portion of the cylindrical rotating valve for securing one or more sprocket or pulleys. A high temperature seal bearing is pressed into each end of the head and circumferentially around the cam shaft.

The head block has a longitudinal cylindrical aperture to receive the cylindrical rotating valve with a larger diameter bore concentric to said aperture on each end of said aperture sufficient in depth to receive pressed high temperature seal bearings. The cylindrical rotating valve extends outside the head block on one end. A keyway is longitudinally provided at such extended end for securing one or more sprocket or pulleys. The head block and cylindrical rotating valve are provided with intake and exhaust steam ports aligned perpendicular to the longitudinal axis of the cylindrical rotating valve. The exhaust steam ports are sized larger than the intake steam ports to allow rapid exhaust of steam cylinder chambers in the engine block to which the steam powered head device is adapted.

One intake steam port and one exhaust steam port through the head block are aligned to adapt to each cylinder chamber of the engine block to which the steam powered head device is adapted. The intake steam ports in the cylindrical rotating valve are aligned radially and sequentially according to the degrees recommended by the manufacturer of the engine block to which the steam powered head device is adapted. Each exhaust steam port in the cylindrical rotating valve is aligned 90 degrees relative to its respective intake steam port in the cylindrical rotating valve. The size and configuration of the head block and cylindrical rotating valve is dependent on the size and configuration of the engine block to which the Steam Powered Head Device is adapted.

A sprocket is typically attached to the cylindrical rotating valve end extending outside the head block, said sprocket providing preferred means to drive a crankshaft in the engine to which the steam powered head device is adapted. The sprocket is sized to maintain a 2 to 1 ratio with the engine crankshaft thereby providing high RPM in the engine. An additional sprocket may be typically attached to the cylindrical rotating valve end outside the head block, preferred means to drive other components such as an air conditioning compressor or an alternator. A pulley may be substituted for a sprocket.

Steam is supplied to the steam powered head device by means of tubes or pipes connected to the top intake steam ports of the head block. Exhausted steam is routed back for recycling through the steam supply system by means of tubes or pipes connected to the top exhaust steam ports in the head block.

The present invention is capable of being adapted to an engine such as to produce high RPMs in the engine. The invention provides for a sprocket or toothed pulley on a portion of the cylindrical rotating valve extending outside the head block. A flexible transmitter engaged with the sprocket or pulley is connected to a corresponding sprocket or pulley on a crankshaft as depicted in FIG. 4. The sprockets or pulleys on the valve and crankshaft are sized so as to provide a 2 to 1 ratio in rotation between the cylindrical rotating valve and the crankshaft. As steam is introduced into an intake steam port, the force of the steam pressure through the head device releases energy which forces or drives the piston in a chamber of an engine down, thereby driving the crankshaft to which the piston is attached. In other words, the cylindrical rotating valve controls the steam into the cylinder so that as the piston is forced down, the crankshaft rotates. Another piston along the crankshaft simultaneously lifts within another chamber and steam is exhausted through an exhaust steam port. As the crankshaft rotates, the rotation drives the sprocket attached to the crankshaft which in turn drives the flexible transmitter which rotates the sprocket on the extended portion of the cylindrical rotating valve outside the head block, thereby rotating the valve and directing steam to another cylinder. The present invention is suitable for adaptation to engines capable of withstanding high RPMs such as multi-cylinder automobile and recreational vehicle engines, including boats, and 2-cycle and 4-cycle engines in boats and yard-care equipment.

The steam powered head device, is constructed with non-corrosive material, for example, stainless steel, copper, brass, or aluminum. The rotational direction of the cylindrical rotating valve within the steam powered head device is predetermined by a starter motor.

Because steam is a lubricant, there is no need for an engine block to use oil to lubricate the pistons. The crankshaft of an engine can be lubricated with grease utilizing grease fittings. Further, where a steam powered generation system is more efficient if heat can be conserved, an engine need not be equipped with a water cooling system. Heat may be conserved by insulating the steam powered head device and associated engine block. Steam may be generated by one of several means known in the art, including a liquid propane gas fired boiler system.

There has thus been outlined, rather broadly, the more important features of the invention in order that the detailed description thereof that follows may be better understood, and in order that the present contribution of the art may be better appreciated. There are additional features of the invention that will be described hereinafter and which will form the subject matter of the claims appended hereto.

In this respect, before explaining at least one embodiment in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is therefore an object of the present invention to provide a Steam Powered Head Device which offers a productive, efficient and environmentally friendly means of powering High RPM Engines.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 also depicts a keyway for securing one or more sprocket or pulleys.

DESCRIPTION OF THE PREFERRED EMBODIMENT

Figure 1:
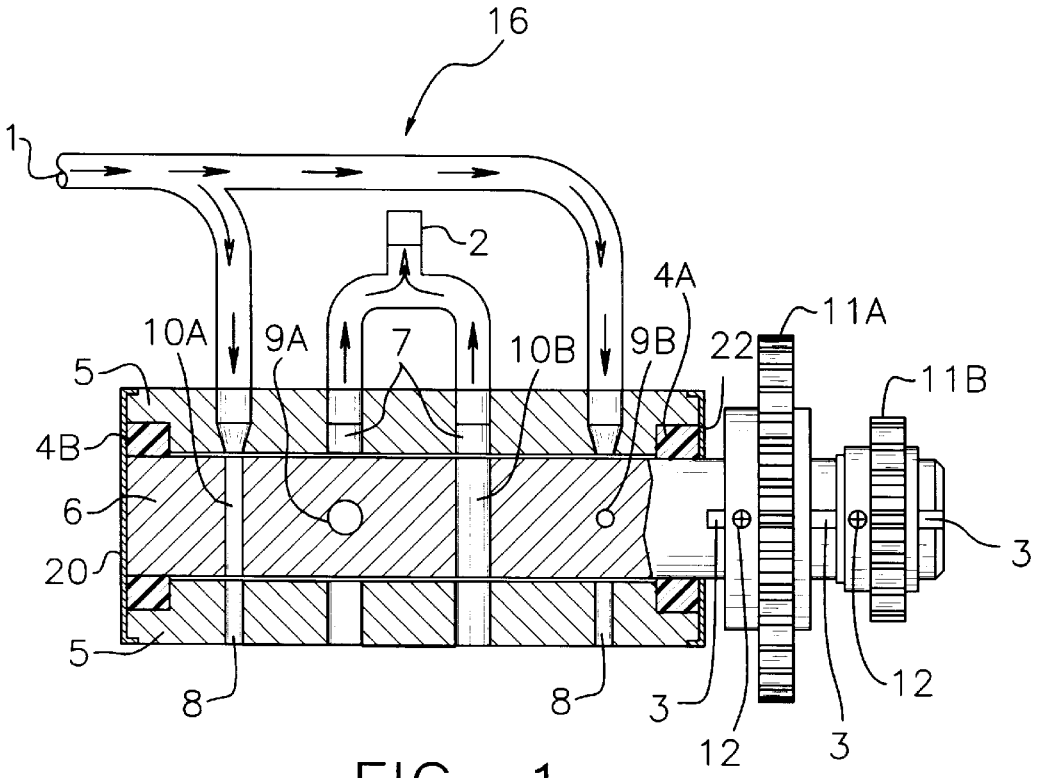
FIG. 1 is a perspective view of the Steam Powered Head Device, depicting a cross-sectional view of the cylindrical rotating valve and head block portions, and depicting steam flow direction for a two cycle engine.
Figure 2:
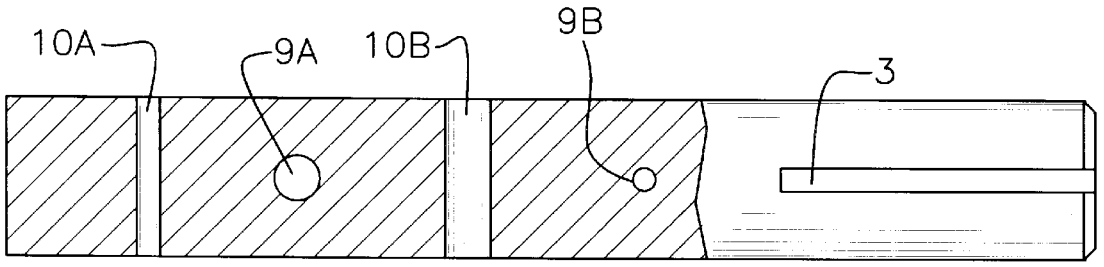
FIG. 2 is a perspective view of the cam shaft herein depicting intake steam ports, and associated exhaust steam ports aligned 90 degrees relative to said intake steam ports.
Figure 3:
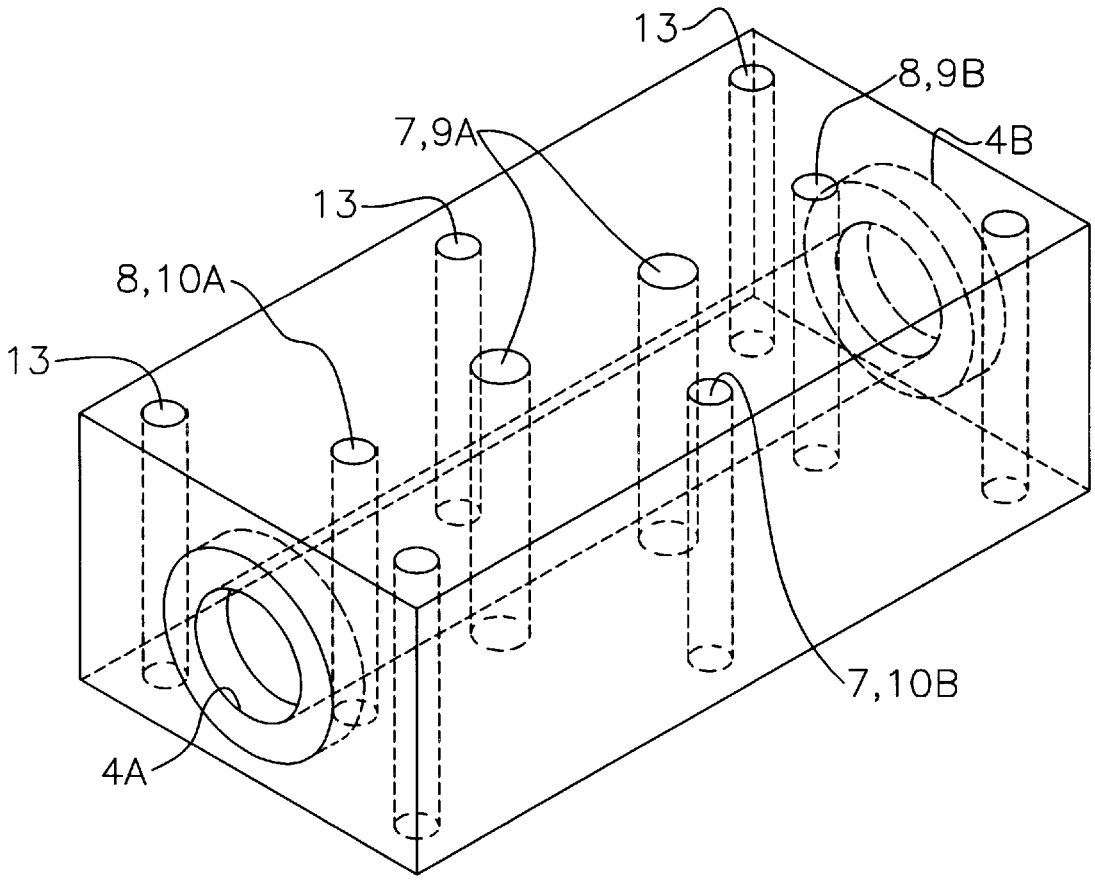
FIG. 3 is a perspective view of the head block depicting intake and exhaust steam ports and typical borings for passing bolts therethrough to secure the head block to the High RPM two cylinder engine block.
Figure 4:
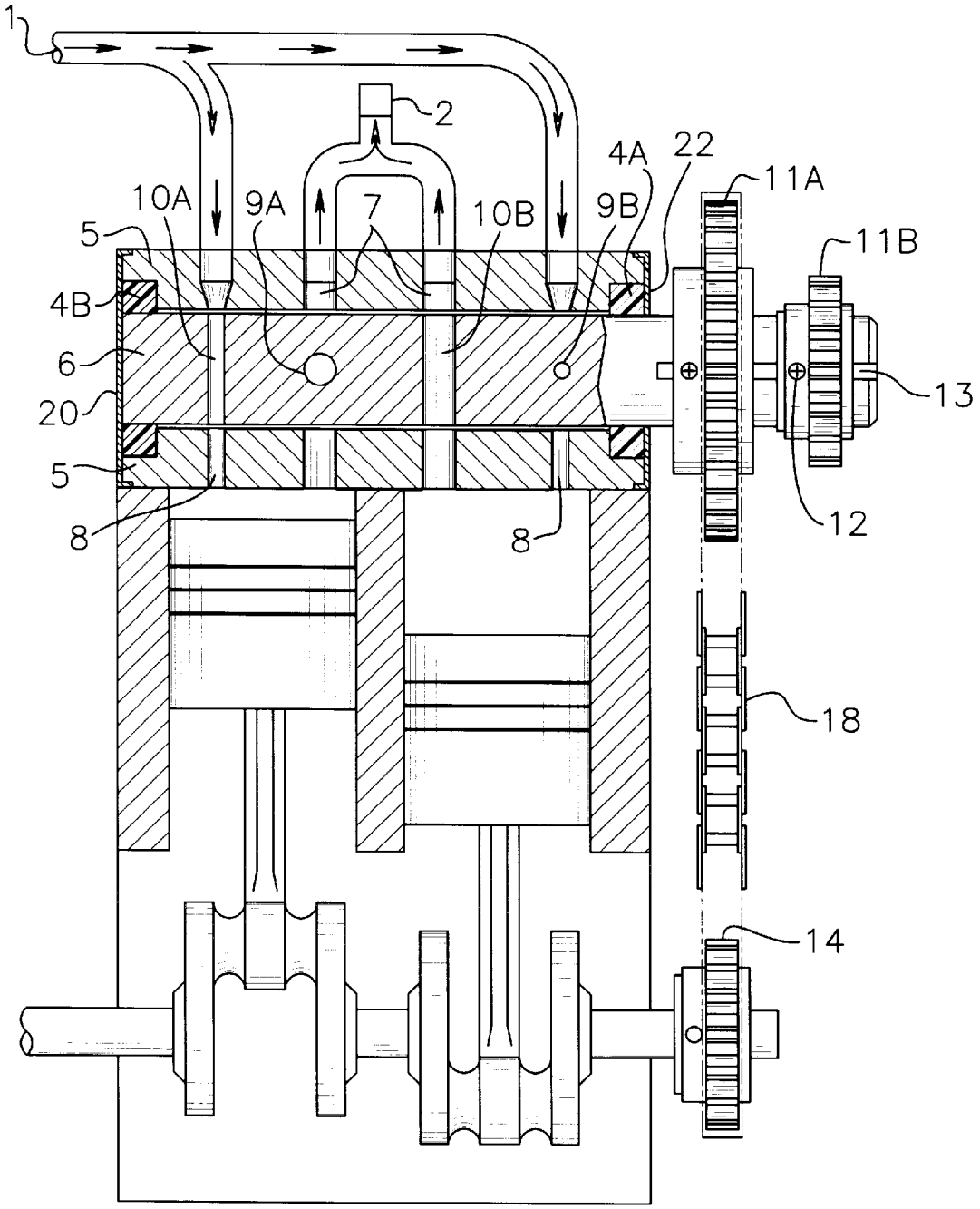
FIG. 4 is a perspective view of the invention herein depicting its use with a High RPM two cylinder engine.

With reference now to the drawings, and in particular to FIGS. 1 through 4 thereof, a new Steam Powered Head Device for High RPM Engines embodying the principles and concepts of the present invention will be described.

As best illustrated in FIGS. 1 through 4, the Steam Powered Head Device for High RPM Engines comprises a head block 5. The head block 5 includes a longitudinal cylindrical aperture for receipt of a cylindrical rotating valve 6. The head block has a larger diameter bore concentric to said aperture on each end of the aperture for receipt of high temperature seal bearings 4A and 4B. The cylindrical rotating valve 6 extends outside the head block on one end. A keyway 3 is longitudinally provided at such extended end for securing a sprocket gear 11A and, if necessary, an additional sprocket 11B. The head block 5 and cylindrical rotating valve 6 are provided with intake steam ports 8, 9B, and 10A and exhaust steam ports 7, 9A, and 10B, the ports being aligned perpendicular to the longitudinal axis of the cam shaft 6.

The exhaust steam ports 7, 9A, and 10B are sized larger than the intake steam ports 8, 9B and 10A to allow rapid exhaust of steam from cylinder chambers in the engine block. The head block 5 and the cylindrical rotating valve 6, are manufactured from non-corrosive material, for example, stainless steel, brass, aluminum. One intake steam port, for example 8 and 10A, and one exhaust steam port, for example 7 and 9A, are aligned to adapt to a cylinder chamber of the engine block to which the Steam Powered Head Device is adapted. The intake steam ports 9B and 10 A in the cylindrical rotating valve 6 are aligned radially and sequentially according to the degrees recommended by the manufacturer of the engine block to which the steam powered head device is adapted. Each exhaust steam port in the cylindrical rotating valve is aligned 90 degrees relative to its associated intake steam ports in the cam shaft, for example, exhaust steam port 9A is aligned 90 degrees from intake steam port 10A. The rotational direction of the cylindrical rotating valve is typically determined by the manufacturer's installation of a starter motor which initiates rotation.

The sprocket gear or dented pulley 11A, alternative means to drive a crankshaft in the engine block to which the steam powered head device is adapted, is sized to maintain a 2 to 1 ratio with the engine crankshaft thereby providing high RPM in the engine. An additional sprocket gear or dented pulley 11B may be attached to the extended portion of the cylindrical rotating valve to drive other components such as an air conditioning compressor or an alternator.

In the preferred embodiment, steam is typically supplied by means of a gas-fired propane boiler through high pressure, high temperature tubes or pipes 1 connected to the head block intake steam ports 8. Exhausted steam is routed back to the boiler system from head block exhaust steam ports 7 through high pressure, high temperature tubes or pipes 2.

As to a further discussion of the manner of usage and operation of the present invention; the same should be apparent from the above description. Accordingly, no further discussion relating to the manner of usage or operation will be provided.

With respect to the above description then, it is to be realized that the optimum dimensional relationship for the parts of the invention, to include variation in size, materials, shape, form function, and manner of operation, assembly and use, are deemed readily apparent and obvious to one skilled in the art, and all equivalent relationships to those illustrated in the drawings and described in the specifications are intended to be encompassed by the present invention.

I claim:

1. A steam powered head device comprising:

a head block, having an interior longitudinal cylindrical aperture therethrough, said head block further including an intake steam port and an exhaust steam port aligned perpendicular to the axis of the longitudinal cylindrical aperture for supplying and exhausting steam in a cylinder chamber in an engine to which the head device is adapted;

a cylindrical rotating valve further including for each cylinder chamber in the engine, an intake steam port aligned perpendicular to the cylindrical rotating valve longitudinal axis and an exhaust steam port aligned 90 degrees from the intake steam port, the cylindrical rotating valve further including an extended portion outside one end of the head block; and means for interconnecting a crankshaft in the engine with the extended portion of the cylindrical rotating valve outside one end of the head block wherein the cylindrical rotating valve controls the steam pressure directed into the cylinder so as a piston is forced down, the crankshaft rotates, simultaneously lifting another piston in another chamber and exhausting steam from that chamber, and simultaneously driving the means for interconnecting the crankshaft and the extended portion of the cylindrical rotating valve outside one end of the head block, thereby rotating the cylindrical rotating valve and directing steam to another cylinder.

2. A head device according to claim 1 wherein the head block includes a larger diameter bore concentric to the interior longitudinal aperture on each end of the aperture, the bores having sufficient depth at each end to press fit a high temperature seal bearing around the cylindrical rotating valve.

3. A head device according to claim 1 wherein the exhaust steam ports in the head block and in the cylindrical rotating valve are sized larger than the respective intake steam ports to allow rapid exhaust of steam from the cylinder chamber in the engine.

4. A head device according to claim 1 wherein the cylindrical rotating valve includes a keyway at the extended portion of the cylindrical rotating valve for securing the means for interconnecting a crankshaft in the engine with the extended portion of the cylindrical rotating valve outside one end of the head block.

5. A head device according to claim 4 wherein the means for interconnecting a crankshaft in the engine with the extended portion of the cylindrical rotating valve outside one end of the head block comprises:

a toothed pulley; and a flexible transmitter engaged with the toothed pulley.

6. A head device according to claim 4 wherein the means for interconnecting a crankshaft in the engine with the extended portion of the cylindrical rotating valve outside one end of the head block comprises:

a sprocket; and a flexible transmitter engaged with the sprocket.

7. A head device according to claim 1 wherein the means for interconnecting a crankshaft in the engine with the extended portion of the cylindrical rotating valve outside one end of the head block is sized to maintain a 2 to 1 ratio.

8. A head device according to claim 1 further comprising a second means secured to the extended portion of the cylindrical rotating valve for driving accessories.

9. A head device according to claim 8 wherein the second means comprises a toothed pulley.

10. A head device according to claim 8 wherein the second means comprises a sprocket.

11. A head device according to claim 1 wherein the head block and the cylindrical rotating valve are made of non-corrosive material.

* * * * *

UNITED STATES PATENT AND TRADEMARK OFFICE
CERTIFICATE OF CORRECTION

PATENT NO : 5,953,914

DATED : September 21, 1999

INVENTOR(S) : Richard Frangipane

It is certified that error appears in the above-identified patent and that said Letters Patent is hereby corrected as shown below:

On title page, item 76 Inventor
replace "3446 53rd St. North. St. Petersburg, Fla. 33710"
with --1159 Keene Road, Dunedin, FL 34698--.

Signed and Sealed this

Twenty-ninth Day of February, 2000

*Attest:*

Q. TODD DICKINSON

*Attesting Officer*

*Commissioner of Patents and Trademarks*